US009548539B2

(12) United States Patent
Du et al.

(10) Patent No.: US 9,548,539 B2
(45) Date of Patent: Jan. 17, 2017

(54) ANTENNA STRUCTURE

(71) Applicant: Arcadyan Technology Corp., Hsinchu (TW)

(72) Inventors: Jian-Jhih Du, Hsinchu (TW); Chih-Yung Huang, Hsinchu (TW); Kuo-Chang Lo, Hsinchu (TW)

(73) Assignee: Arcadyan Technology Corp., Hsinchu (TW)

( * ) Notice: Subject to any disclaimer, the term of this patent is extended or adjusted under 35 U.S.C. 154(b) by 160 days.

(21) Appl. No.: 14/523,549

(22) Filed: Oct. 24, 2014

(65) Prior Publication Data

US 2015/0145743 A1 May 28, 2015

(30) Foreign Application Priority Data

Nov. 25, 2013 (TW) ..... 102142895 A

(51) Int. Cl.
*H01Q 9/28* (2006.01)
*H01Q 1/38* (2006.01)

(52) U.S. Cl.
CPC ..... *H01Q 9/285* (2013.01); *H01Q 1/38* (2013.01)

(58) Field of Classification Search
CPC ..... H01Q 9/285; H01Q 1/38
See application file for complete search history.

(56) References Cited

U.S. PATENT DOCUMENTS

2006/0061513 A1 3/2006 Sato
2013/0021218 A1* 1/2013 Asanuma ..... H01Q 9/285 343/810

OTHER PUBLICATIONS

The Office Action and Search Report for the TW 102142895 application.

* cited by examiner

*Primary Examiner* — Hoang V Nguyen
*Assistant Examiner* — Michael Bouizza
(74) *Attorney, Agent, or Firm* — Haverstock & Owens LLP

(57) ABSTRACT

An antenna structure is disclosed. The antenna structure includes a symmetrizing portion and two radiation portions. The symmetrizing portion has an axis and two radiation portions are symmetrically connected to the symmetrizing portion along the axis. Each of the two radiation portions is formed in a boot shape within a quadrilateral region having a first edge with a first length, a second edge with a second length, a third edge with a third length and a fourth edge with a fourth length. Each radiation portion includes a first side having a length being equivalent to the first length, a second side having a length being equivalent to the second length, a third side having a length being at least one-sixth of the third length, a fourth side having a length being at least one-fifth of the fourth length, and a fifth side connecting the third side and the fourth side and forming an arc, wherein the arc follows a quarter trajectory of an ellipse.

20 Claims, 5 Drawing Sheets

ANTENNA STRUCTURE

CROSS-REFERENCE TO RELATED APPLICATION AND CLAIM OF PRIORITY

The application claims the benefit of Taiwan Patent Application No. 102142895, filed on Nov. 25, 2013, at the Taiwan Intellectual Property Office, the disclosures of which are incorporated herein in their entirety by reference.

FIELD OF THE INVENTION

The present invention relates to an antenna structure, and more particularly to a dipole antenna structure for electronic devices or wireless transmission devices.

BACKGROUND OF THE INVENTION

Amid the technological advances of the modern era, various sizes and types of antennas have been developed, and are applied in various lightweight portable electronic devices, such as mobile phones and notebooks, or wireless transmission devices, such as AP and Card Bus. For instance, a planar inverse-F antenna (PIFA), monopole antenna or dipole antenna, which is lightweight and simple, cheap, easily manufactured, has good transmission efficiency and can be easily set in the inner wall of a portable electronic device, already exists. These antennas have been applied to wireless transmission in many portable electronic devices, notebooks and wireless communication devices. In conventional technology, the inner conductive layer and the outer conductive layer of the coaxial cable are welded to the signal feed point and the signal ground point of a PIFA respectively to transmit the signal via the PIFA.

A dipole antenna is one of the most conventional and classical antenna designs. However, the resonance frequency bandwidth of a conventional dipole antenna is narrow, and can not satisfy the requirements of some practical applications. Although much research about changing the antenna structure to increase the bandwidth of the dipole antenna and resonance frequency has been conducted, additional extended structures are needed to increase the bandwidth and resonance frequency of a dipole antenna. At the same time, the size of the antenna must increase, and its applicability for lightweight and small electronic components is limited.

In order to overcome the drawbacks in the prior art, an antenna structure is disclosed. The particular design in the present invention not only solves the problems described above, but is also easy to implement. Thus, the present invention has utility for industry.

SUMMARY OF THE INVENTION

In accordance with one aspect of the present invention, an antenna structure is disclosed. The antenna structure includes a symmetrizing portion having an axis and two radiation portions symmetrically connected to the symmetrizing portion along the axis. Each of the two radiation portions is formed in a boot shape within a quadrilateral region having a first edge with a first length, a second edge with a second length, a third edge with a third length and a fourth edge with a fourth length. Each radiation portion includes a first side having a length being equivalent to the first length, a second side having a length being equivalent to the second length, a third side having a length being at least one-sixth of the third length, a fourth side having a length being at least one-fifth of the fourth length, and a fifth side connecting the third side and the fourth side and forming an arc, wherein the arc follows a quarter trajectory of an ellipse.

In accordance with another aspect of the present invention, an antenna structure is disclosed. The antenna structure includes a symmetrizing portion having an axis and a first radiation portion and a second radiation portion formed symmetrically adjacent to the symmetrizing portion along the axis. Each radiation portion is formed within a quadrilateral region having a first edge, a second edge, a third edge and a fourth edge, and each radiation portion includes a first side having a first length corresponding to the first edge, a second side having a second length corresponding to the second edge, a third side having a third length corresponding to the third edge, a fourth side having a fourth length corresponding to the fourth edge and a fifth side being an arc located within the quadrilateral region and connecting the third side and the fourth side with a specific curvature.

In accordance with a further aspect of the present invention, an antenna structure is disclosed. The antenna structure includes a symmetrizing portion having an axis and a first radiation portion and a second radiation portion formed symmetrically along the axis. Each of the first and second radiation portions includes a quadrilateral region, a printed portion having a first area formed within the quadrilateral region and an unprinted portion having a second area formed within the quadrilateral region. The quadrilateral region is partitioned into the first area and the second area by an arc with a specific curvature.

The objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; they are not intended to be exhaustive or to be limited to the precise form disclosed.

The purpose of the present invention is to provide a dipole antenna structure in which the built-in dipole antenna is suitable for use in wireless transmission devices, such as a notebook, personal digital assistant (PDA), mobile phone etc., and can be easily adjusted and amended according to the requirements of the products to achieve a suitable application. The embodiments can be applied in the operation frequency band for WiFi 802.11b/g/n (2.40~2.50 GHz), in the operation frequency band of Long Term Evolution (LTE), such as LTE-Band 7 (2500~2690 MHz), LTE-Band 40 (2300~2400 MHz) and LTE-Band 38 (2570~2620 MHz), in wireless communication devices, such as a notebook, mobile phone, AP, TV or DVD including WiFi, in the LTE frequency band of 2300 MHz~2700 MHz, or in another operation frequency band for a wireless communication system by adjusting the frequency band slightly.

Figure 1:
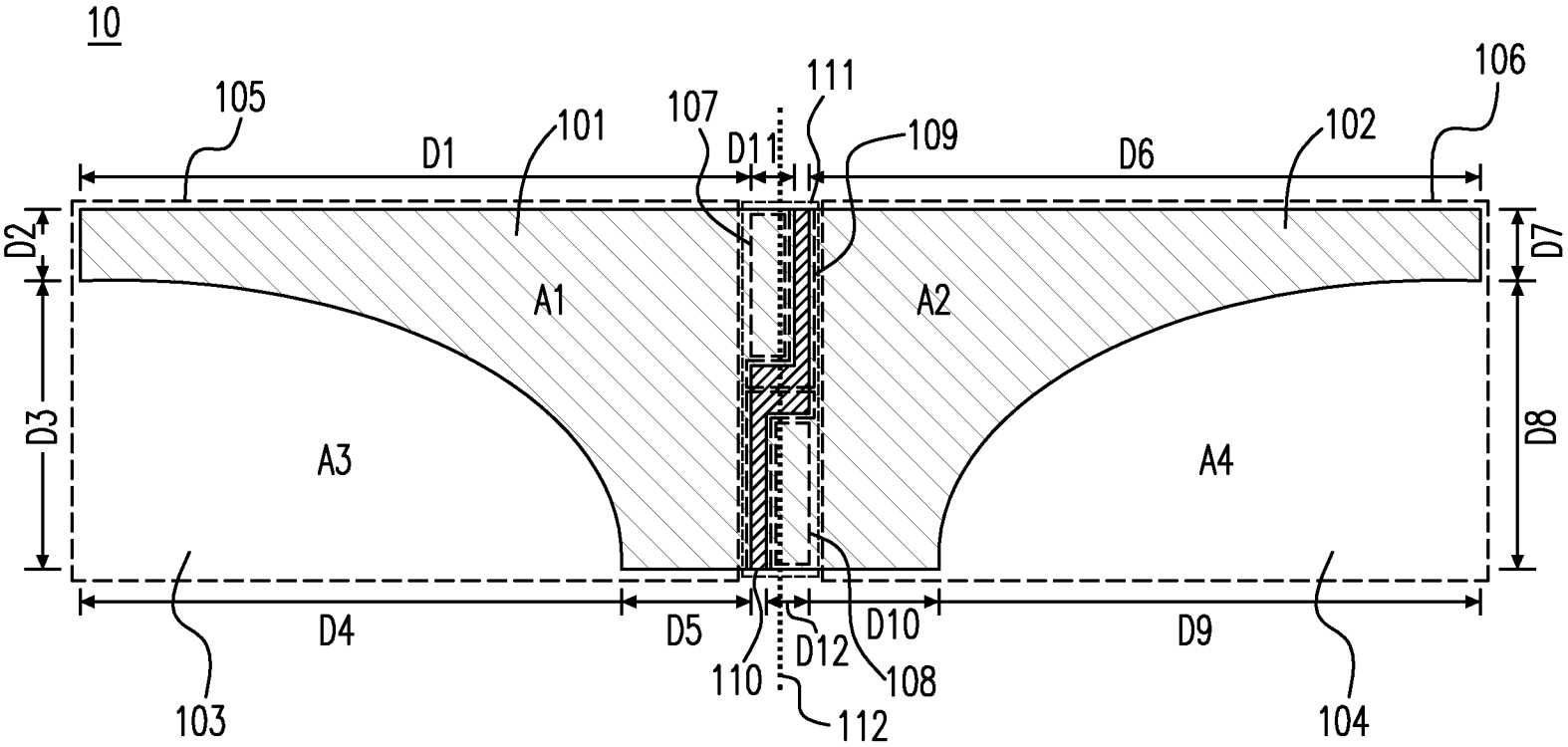
FIG. 1 shows the front view of the antenna structure according to a preferred embodiment of the present invention.

Please refer to FIG. 1, which shows the front view of the antenna structure 10 according to a preferred embodiment of the present invention. As shown in FIG. 1, in the present invention, an integrated printed antenna structure 10 is configured on a substrate. The antenna structure 10 has a single central operating frequency, and has a first radiation portion 101, a second radiation portion 102, a first slot region 103, a second slot region 104, a first rectangular structure 107, a second rectangular structure 108, gap structures 109 and 110, a symmetrizing portion 111 and an axis 112, wherein the first radiation portion 101 and the first slot region 103 form a first quadrilateral region 105, and the second radiation 102 and the second slot region 104 form a second quadrilateral region 106.

The antenna structure includes the first quadrilateral region 105 and the second quadrilateral region 106. The first quadrilateral region 105 includes a first printed portion and a first unprinted portion, the first printed portion has a first area A1, and the first unprinted portion has a second area A3. The second quadrilateral region 106 includes a second printed portion and a second unprinted portion, the second printed portion has a third area A2, and the second unprinted portion has a fourth area A4.

The first printed portion and the first unprinted portion form a first total area (A1+A3), the second printed portion and the second unprinted portion form a second total area (A2+A4), and the first total area equals the second total area.

The antenna structure 10 includes a symmetrizing portion 111 having an axis 112, and the first radiation portion 101 and the second radiation portion 102 formed symmetrically adjacent to the symmetrizing portion 111 along the axis 112. There are the first rectangular structure 107, the second rectangular structure 108 and the gap structures 109 and 110, wherein the first radiation portion 101 and the first rectangular structure 107 form a first coplanar region, and the second radiation portion 102 and the second rectangular structure 108 form a second coplanar region. The first coplanar region and the second coplanar region are coplanar, and the gap structures are disposed between the first coplanar region and the second coplanar region to isolate the coplanar regions.

The first rectangular structure is rotationally symmetric to the second rectangular structure about a reference position, and the first rectangular structure 107 and the second rectangular structure 108 have a first width D11 and a second width D12, respectively.

The first quadrilateral region 105 has a first edge, a second edge, a third edge and a fourth edge, and the first radiation portion 101 has a first side, a second side, a third side, a fourth side and a fifth side. The first side has a first length (D1+D11) corresponding to the first edge, the second side has a second length (D2+D3) corresponding to the second edge, the third side has a third length D5 corresponding to the third edge, the fourth side has a fourth length D2 corresponding to the fourth edge, and the fifth side is an arc located within the first quadrilateral region 105 and connecting the third side and the fourth side with a specific curvature, wherein the first length (D1+D11) determines a central operating frequency of the antenna structure 10.

The second quadrilateral region 106 has a first edge, a second edge, a third edge and a fourth edge, and the second radiation portion 102 has a first side, a second side, a third side, a fourth side and a fifth side. The first side has a first length D6 corresponding to the first edge, the second side has a second length (D7+D8) corresponding to the second edge, the third side has a third length (D10+D12) corresponding to the third edge, the fourth side has a fourth length D7 corresponding to the fourth edge, and the fifth side is an arc located within the second quadrilateral region 106 and connecting the third side and the fourth side with a specific curvature, wherein the first length D6 determines a central operating frequency of the antenna structure 10. The specific curvature of the fifth side follows a quarter trajectory of an ellipse.

Half of the wavelength of the central operating frequency of the antenna structure 10 is the total of the first lengths of the first radiation portion 101 and the second radiation portion 102 (D1+D11+D6), wherein the first width D11 is very small, which is 1.6% of the wavelength. Therefore, the effect that the first width D11 applies to the change of the central operating frequency can be omitted.

The third sides D5 and (D10+D12) of the first and the second radiation portions 101 and 102 are at least one-sixth of the third edges (D4+D5) and (D9+D10) of the first and the second quadrilateral regions 105 and 106. The fourth sides D2 and D7 of the first and the second radiation portions 101 and 102 are at least one-fifth of the fourth edges (D2+D3) and (D7+D8) of the first and the second quadrilateral regions 105 and 106. Because the second width D12 is very small, which is 1.6% of the wavelength, the effect that the second width D12 applies to the change of the central operating frequency can be omitted, which will not affect the characteristics of the antenna structure.

The second area A3 of the first slot region 103 of the first quadrilateral region 105 and the fourth area A4 of the second slot region 104 of the second quadrilateral region 106 determine an operating bandwidth and an impedance match of the antenna structure 10.

The first slot region 103 has a quarter-ellipse structure, wherein the quarter-ellipse structure is surrounded by a first extended side extended from the third side, a second extended side extended from the fourth side and a first curved side, and the first curved side equals the fifth side of the first radiation portion 101. The first extended side and the second extended side have a first extended length D4 and a second extended length D3, respectively. The second slot region 104 has a quarter-ellipse structure, wherein the quarter-ellipse structure is surrounded by a first extended side extended from the third side, a second extended side extended from the fourth side and a second curved side, and the second curved side equals the fifth side of the second radiation portion 102. The first extended side and the second extended side have a third extended length D9 and a fourth extended length D8, respectively. The second extended length D3 and the first extended length D4 form a first aspect ratio (D3/D4), and the fourth extended length D8 and the third extended length D9 form a second aspect ratio (D8/

D9). The first and the second aspect ratios determine the operating bandwidth and the impedance match of the antenna structure 10.

By fixing the third length D5 of the first radiation portion 101 and increasing the second extended length D3, the value of the first aspect ratio (D3/D4) is increased, and thus the operating bandwidth of the antenna structure 10 shifts to a higher frequency bandwidth. In addition, by fixing the fourth length D2 of the first radiation portion 101 and increasing the third length D5, the first extended length D4 is decreased, the value of the first aspect ratio (D3/D4) is increased, and thus the operating bandwidth of the antenna structure 10 shifts to a higher frequency bandwidth.

When the value of the first aspect ratio (D3/D4) or the second aspect ratio (D8/D9) is less than 0.56, the operating bandwidth shifts to a lower frequency bandwidth; when this value is more than 0.62, the operating bandwidth shifts to a higher frequency bandwidth. As shown in FIG. 1, the first radiation portion 101 includes a first printed portion and a first unprinted portion. The first printed portion includes a first boot-shaped structure and a first rectangular structure. The first boot-shaped structure has a first periphery, and the first periphery has a first side, a second side having an upper portion and a lower portion, a third side opposite to the first side, a fourth side opposite to the second side and a first curved side, wherein the first side and the fourth side form a first right angle, the first side and the second side form a second right angle, and the second side and the third side form a third right angle. The first rectangular structure extends from the upper portion of the second side and is coplanar with the first boot-shaped structure. The first unprinted portion is the first slot region, and has a first quarter-ellipse structure, wherein the first quarter-ellipse structure is surrounded by a first extended side extending from the third side, a second extended side extending from the fourth side and a first curved side. The first slot region has a first aspect ratio, and the first aspect ratio is a length ratio of the second extended side to the first extended side (D3/D4). The first extended side and the second extended side form a first extended right angle. The first curved side follows an elliptical trajectory of the first quarter-ellipse structure.

The second radiation portion 102 includes a second printed portion and a second unprinted portion. The second printed portion includes a second boot-shaped structure and a second rectangular structure. The second boot-shaped structure has a second periphery, and the second periphery has a fifth side, a sixth side having an upper portion and a lower portion, a seventh side opposite to the fifth side, an eighth side opposite to the sixth side and a second curved side, wherein the fifth side and the eighth side form a fourth right angle, the fifth side and the sixth side form a fifth right angle, and the sixth side and the seventh side form a sixth right angle. The second rectangular structure extends from the lower portion of the sixth side and is coplanar with the second boot-shaped structure. The second unprinted portion is the second slot region, and has a second quarter-ellipse structure, wherein the second quarter-ellipse structure is surrounded by a third extended side extending from the seventh side, a fourth extended side extending from the eighth side and a second curved side. The second slot region has a second aspect ratio, and the second aspect ratio is a length ratio of the fourth extended side to the third extended side (D8/D9). The third extended side and the fourth extended side form a second extended right angle. The second curved side follows an elliptical trajectory of the second quarter-ellipse structure. The first boot-shaped structure and the second boot-shaped structure have mirror symmetry.

The first aspect ratio ranges from 0.56 to 0.62, and the second aspect ratio ranges from 0.56 to 0.62. A gap structure is disposed between the first radiation portion 101 and the second radiation portion 102, and includes an inverted L-shaped structure 109 and a reverse L-shaped structure 110. The inverted L-shaped structure consists of a first rectangular portion and a second rectangular portion. The first rectangular portion has a first long side, a second long side opposite to the first long side, a first upper portion and a first lower portion. The second rectangular portion extends from the second long side and the first lower portion and forms a right angle with the first rectangular portion. The reverse L-shaped structure 110 consists of a third rectangular portion and a fourth rectangular portion. The fourth rectangular portion has a third long side, a fourth long side opposite to the third long side, a second upper portion and a second lower portion. The third rectangular portion extends from the third long side and the second upper portion and forms a right angle with the fourth rectangular portion. The first, second, third and fourth rectangular portions are coplanar. The first and second rectangular portions have sizes equivalent to those of the fourth and the third rectangular portions, respectively. The second and the third rectangular portions have sizes less than those of the first and the fourth rectangular portions respectively. The inverted L-shaped structure 109 is rotationally symmetric to the reverse L-shaped structure 110 about a reference position.

Figure 2:
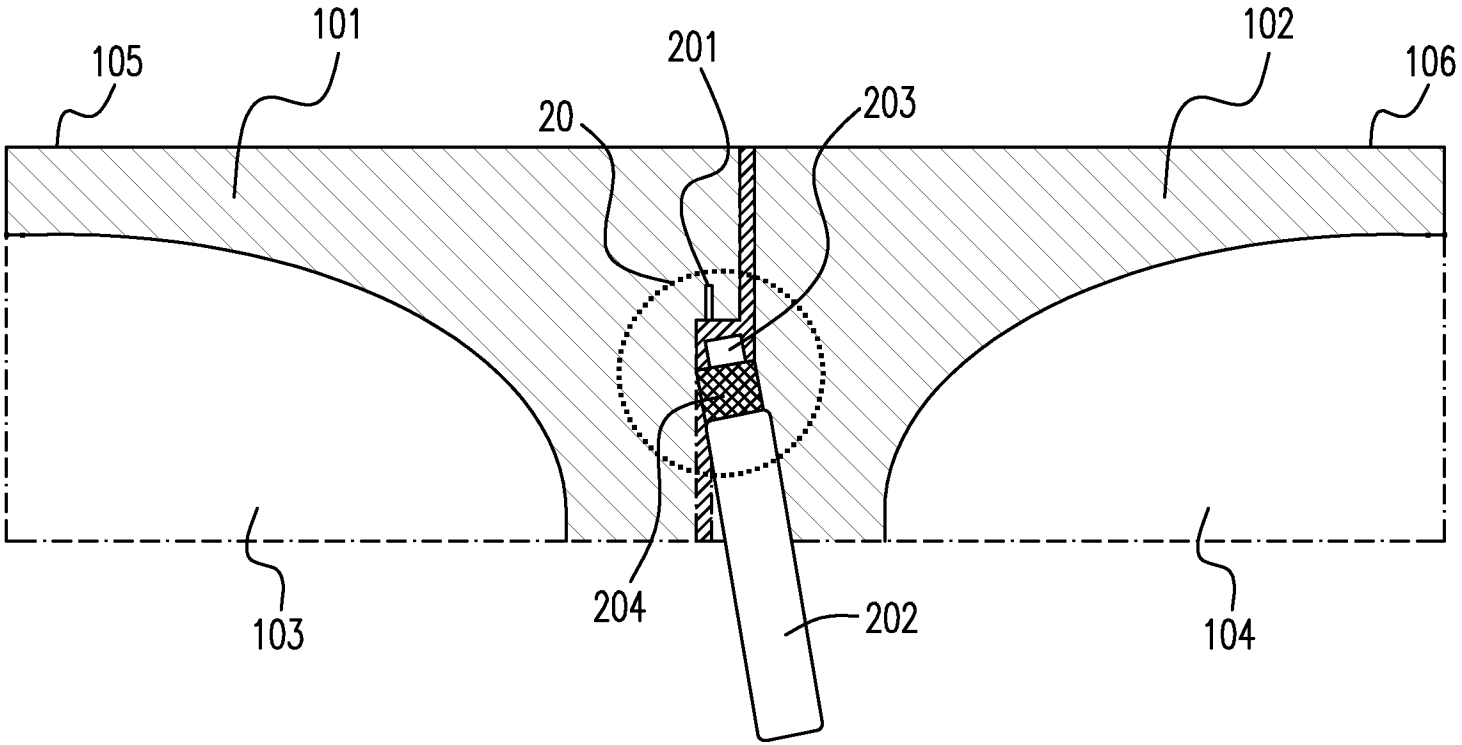
FIG. 2 shows the diagram of a signal feed area of the antenna structure according to a preferred embodiment of the present invention.

Please refer to FIG. 2, which shows the front view of the feed terminal and ground terminal of the antenna structure according to a preferred embodiment of the present invention. As shown in FIG. 1 and FIG. 2, an antenna structure 10 which has gap structures 109 and 110 in the central part thereof is printed in the present invention. The antenna structure 10 includes a signal feed area 20, and the signal feed area 20 is located in the gap structures 109 and 110 and includes a feed terminal 201, a cable 202 and a ground terminal 203, wherein the cable 202 further includes an isolation layer 204.

The ground terminal 203 is free from a connection to a substrate, the feed terminal 201 and the ground terminal 203 are configured to connect to a coaxial cable, the coaxial cable includes a feed line, a ground line, and an isolation layer disposed between the feed line and the ground line to isolate the feed line from the ground line.

The substrate (not shown) configured for the antenna structure 10 is a printed circuit board, and the printed circuit board includes a first area, a second area and a third area (not shown). The first area is located on a first plane of the substrate and has the antenna structure. The second area is located on a second plane of the substrate and has a non-metal plane. The third area is located on the second plane and has a metal plane, wherein the third area further has a non-metal plane.

Figure 3:
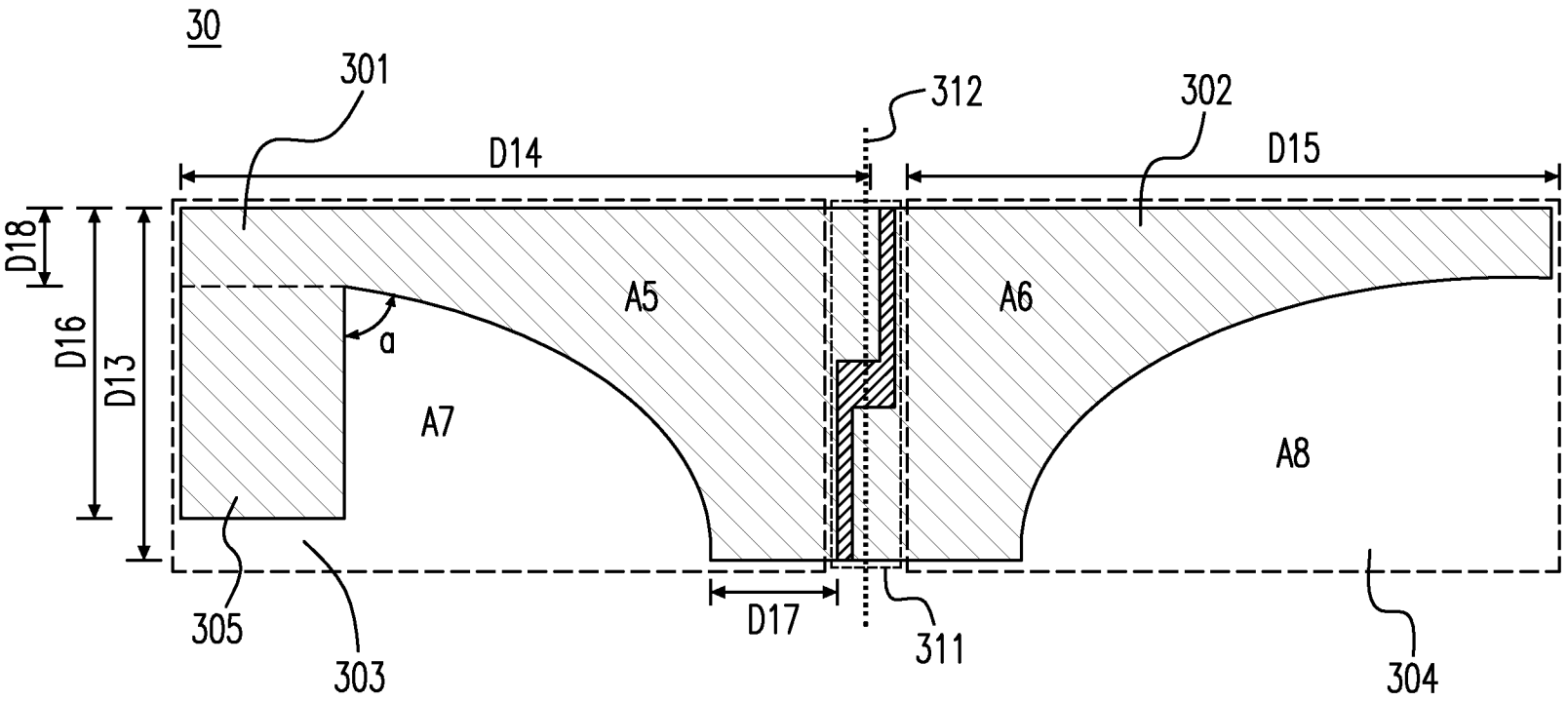
FIG. 3 shows the front view of the antenna structure according to another preferred embodiment of the present invention.

Please refer to FIG. 3, which shows the front view of the antenna structure 30 according to another preferred embodiment of the present invention. The antenna structure 30 includes a symmetrizing portion 311 having an axis 312, a first radiation portion 301 and a second radiation portion 302. Each radiation portion is formed within a quadrilateral region having a first edge, a second edge, a third edge and a fourth edge. Each radiation portion includes a first side having a first length corresponding to the first edge, a second side having a second length corresponding to the second edge, a third side having a third length corresponding to the third edge, a fourth side having a fourth length corresponding to the fourth edge and a fifth side being an arc located within the quadrilateral region and connecting the third side and the fourth side with a specific curvature.

The first radiation portion 301 further includes a first extended portion 305. The first extended portion 305 is located in the quadrilateral region and is extended from the fifth side. The first extended portion 305 and the first radiation portion 301 form a first angle α less than 90 degrees. The first length D14 of the first side and the length D16 of the first extended portion 305 determine a central operating frequency of the antenna structure 30. The first and second lengths D14 and D13 are at least twice the third and fourth lengths D17 and D18, respectively. The fifth side follows a quarter trajectory of an ellipse. The first radiation portion 301 and the first extended portion 305 have a first area A5 , and the second radiation portion 302 has a second area A6. The quadrilateral regions have a first slot region 303 and a second slot region 304 corresponding to the first and the second radiation portions 301 and 302, respectively, wherein the first slot region 303 and the second slot region 304 have a third area A7 and a fourth area A8, respectively to determine an operating bandwidth an a impedance match of the antenna structure 30.

The design of the first extended portion 305 is under the condition that the overall size of the antenna structure does not become larger while the length of the first radiation portion 301 is increased to obtain the desired central frequency. The third area A7 of the first slot region 303 is used to determine the impedance match of the antenna structure 30.

The second radiation portion 302 further includes a second extended portion (not shown). The second extended portion is located in the quadrilateral region and is extended from the fifth side. The second extended portion and the second radiation portion 302 form a second angle of less than 90 degrees. The second extended portion is symmetrical to the first extended portion 305 about the axis. The design of the first extended portion 305 and the second extended portion are under the condition that the overall size of the antenna structure does not become larger while the lengths of the first radiation portion 301 and the second radiation portion 302 are increased to obtain the desired central frequency. The third area A7 of the first slot region 303 and the fourth area A8 of the second slot region 304 are used to determine the operating bandwidth and the impedance match of the antenna structure 30.

Figure 4:
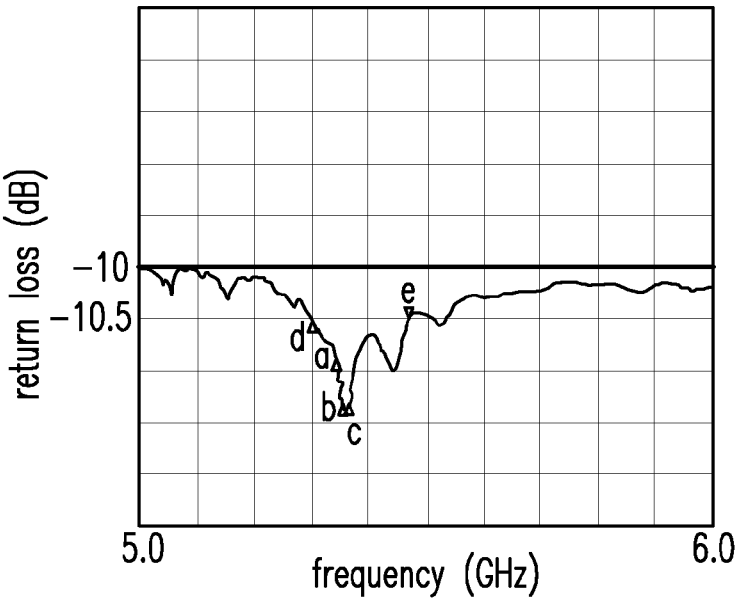
FIG. 4 is a graph showing the return loss of the antenna structure according to a preferred embodiment of the present invention.

Please refer to FIG. 4, which shows the change chart of return loss of the antenna structure (such as FIG. 1) according to a preferred embodiment of the present invention. The vertical axis of FIG. 4 is return loss (unit: dB), and the horizontal axis is frequency (unit: GHz). As shown in FIG. 4, the change of central operating frequency is observed between the frequency range of 2.15~3.08 GHz and when the return loss is −10 dB, the return loss/frequency (dB/GHz) value of point a, point b, point c, point d and point e are −17.82/2.40, −23.15/2.45, −23.18/2.50, −10.47/2.15 and −10.26/3.08, respectively, which shows that the central operating frequency of the antenna structure of the present invention is 930 MHz, and can be used for any wireless communication whose bandwidth conforms with the IEEE 802.11bg specification.

Figure 5:
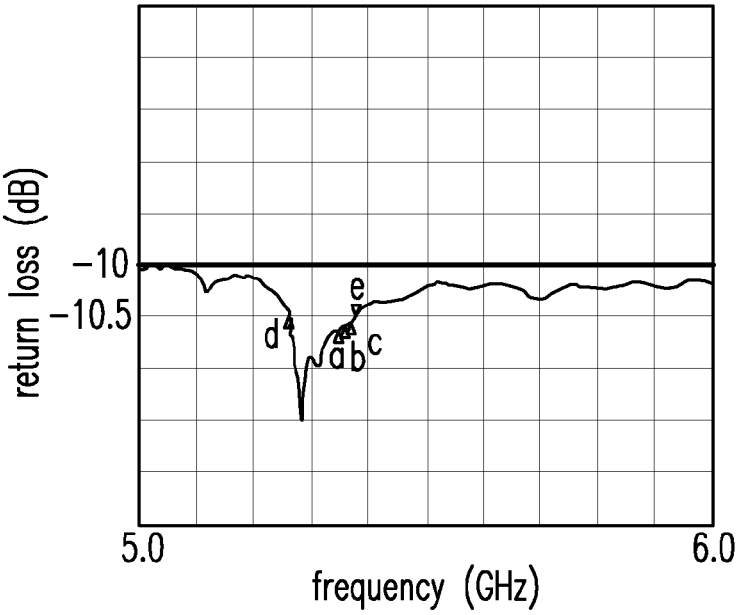
FIG. 5 is a graph showing the return loss of the antenna structure according to another preferred embodiment of the present invention.

Please refer to FIG. 5, which shows the change chart of return loss of the antenna structure (such as FIG. 3) according to another preferred embodiment of the present invention. The vertical axis of FIG. 5 is return loss (unit: dB), and the horizontal axis is frequency (unit: GHz). As shown in FIG. 5, the change of central operating frequency is observed between the frequency range of 1.94~2.57 GHz and when the return loss is −10 dB, the return loss/frequency (dB/GHz) value of point a, point b, point c, point d and point e are −12.65/2.40, −12.06/2.45, −11.42/2.50, −10.47/1.94 and −10.53/2.57, respectively, which shows that the central operating frequency of the antenna structure of a preferred embodiment of the present invention is 630 MHz, and can be used with any wireless communication whose bandwidth conforms with the LTE (2300-2700 MHz) specification.

From FIG. 4 and FIG. 5, it can be seen that the present invention can achieve the purpose that the central operating frequency and operating bandwidth of the antenna structure can be altered.

Figure 6:
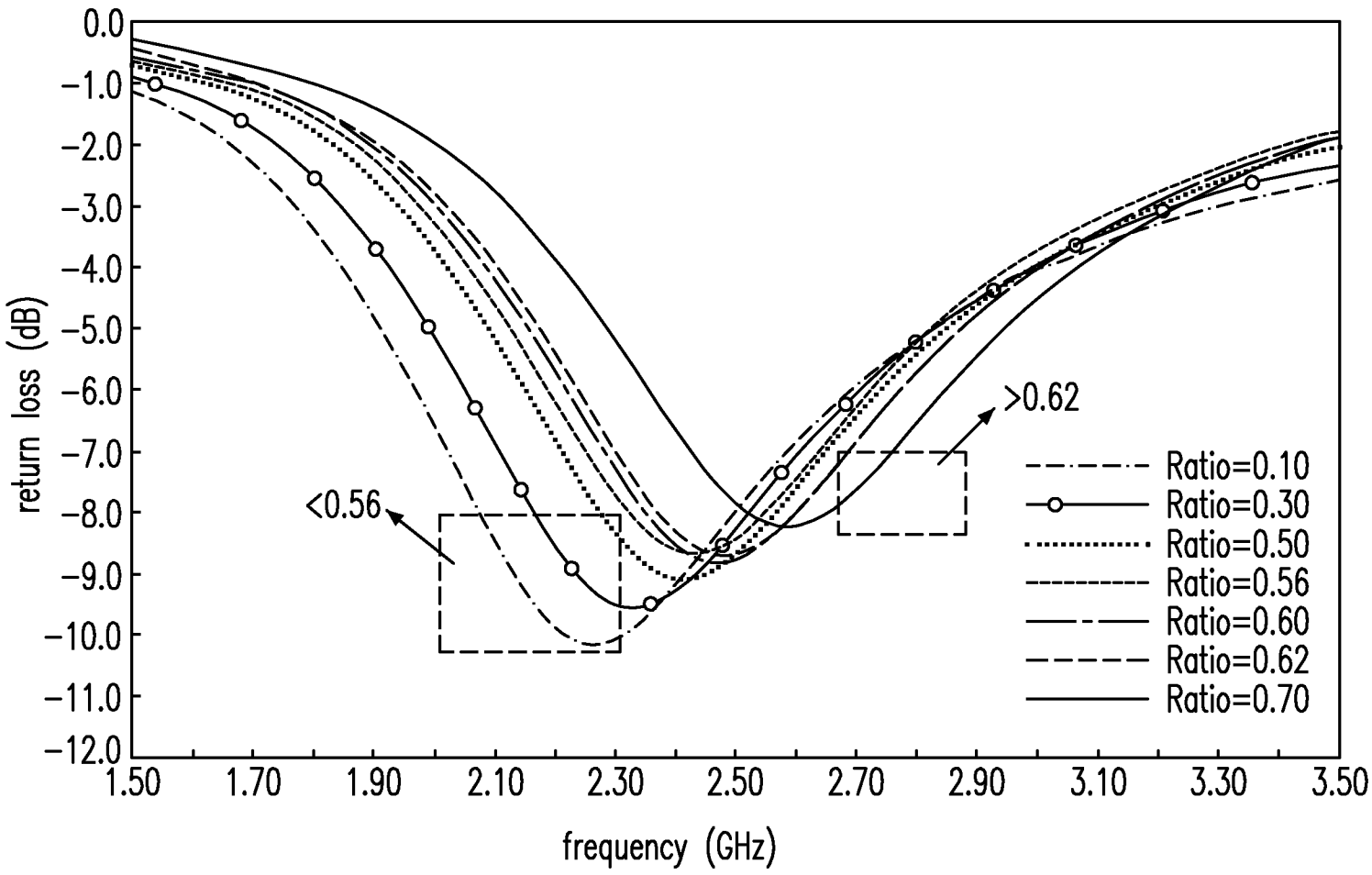
FIG. 6 is a graph showing the return losses of the antenna structures having different sizes of slot regions according to the present invention.

Please refer to FIG. 6, which shows the simulation change chart of return losses of the antenna structures having different sizes of slot regions according to the present invention. The vertical axis of FIG. 6 is return loss (unit: dB), and the horizontal axis is frequency (unit: GHz). FIG. 6 is a simulation result, and the return loss is not more than −10 dB. However, it can be seen that adjusting the aspect ratio of the slot region affects the response of the system frequency of the antenna structure. When the aspect ratio ranges from 0.56 to 0.62, the central frequency does not have an obvious shift (bandwidth is 2.4-2.5 GHz), and the impedance match conforms to a consistent value. However, when the aspect ratio is less than 0.56, the central frequency shifts to the left (low frequency), and the bandwidth can be different. When the aspect ratio is more than 0.62, not only does the central operating frequency shift to the right (high frequency), but also the impedance match is worse and the bandwidth can be different. This shows that the aspect ratio determines the operating bandwidth and the impedance match of the antenna structure.

Embodiments

1. An antenna structure includes a symmetrizing portion and two radiation portions. The symmetrizing portion has an axis, and two radiation portions are symmetrically connected to the symmetrizing portion along the axis. Each of the two radiation portions is formed in a boot shape within a quadrilateral region having a first edge with a first length, a second edge with a second length, a third edge with a third length and a fourth edge with a fourth length. Each radiation portion includes a first side having a length being equivalent to the first length, a second side having a length being equivalent to the second length, a third side having a length being at least one-sixth of the third length, a fourth side having a length being at least one-fifth of the fourth length, and a fifth side connecting the third side and the fourth side and forming an arc, wherein the arc follows a quarter trajectory of an ellipse.

2. The antenna structure of Embodiment 1 further includes two non-radiation portions. Each of the non-radiation portions is formed within the quadrilateral region and connected to the respective radiation portion, and has a quarter-elliptical area defined by a first extended side extending from the third side, a second extended side extending from the fourth side, and the fifth side.

3. In the antenna of Embodiments 1-2, the first side and the fourth side form a first right angle, the first side and the second side form a second right angle, and the second side and the third side form a third right angle.

4. An antenna structure includes a symmetrizing portion having an axis and a first radiation portion and a second radiation portion formed symmetrically adjacent to the symmetrizing portion along the axis. Each radiation portion is formed within a quadrilateral region having a first edge, a second edge, a third edge and a fourth edge. Each radiation portion includes a first side, a second side, a third side, a fourth side and a fifth side. The first side has a first length corresponding to the first edge. The second side has a second length corresponding to the second edge. The third side has a third length corresponding to the third edge. The fourth side has a fourth length corresponding to the fourth edge. The fifth side is an arc located within the quadrilateral region and connects the third side and the fourth side with a specific curvature.

5. The antenna structure of Embodiment 4 further includes a first extended portion. The first extended portion has a first extended length, is adjacent to the first radiation portion and is located within the quadrilateral region. The first extended portion extends from an end of the fifth side and along the fourth side, and the first extended portion and the first radiation portion form a first angle less than 90 degrees.

6. In the antenna structure of Embodiments 4-5, the first length and the first extended length determine a central operating frequency of the antenna structure, the first length and the second length are at least twice the third length and the fourth length, respectively, and the fifth side follows a quarter trajectory of an ellipse.

7. The antenna structure of Embodiments 4-6 further includes a second extended portion. The second extended portion has a second extended length, is adjacent to the second radiation portion and is located within the quadrilateral region. The second extended portion extends from the end of the fifth side and along the fourth side, and the second extended portion and the second radiation portion form a second angle of less than 90 degrees.

8. In the antenna structure of Embodiments 4-7, the first extended portion is symmetrical to the second extended portion about the axis.

9. An antenna structure includes a symmetrizing portion, a first radiation portion and a second radiation portion. The symmetrizing portion has an axis. The first radiation portion and the second radiation portion are formed symmetrically along the axis. Each of the first and second radiation portions includes a quadrilateral region, a printed portion and an unprinted portion. The printed portion has a first area formed within the quadrilateral region, and the unprinted portion has a second area formed within the quadrilateral region. The quadrilateral region is partitioned into the first area and the second area by an arc with a specific curvature.

10. In the antenna structure of Embodiment 9, the first radiation portion includes the first printed portion. The first printed portion includes a first boot-shaped structure and a first rectangular structure. The first boot-shaped structure has a first periphery. The first periphery includes a first side, a second side, a third side, a fourth side and a first curved side. The second side has an upper portion and a lower portion, the third side is opposite to the first side, the fourth side is opposite to the second side. The first rectangular structure is connected to the upper portion and coplanar with the first boot-shaped structure. The first unprinted portion is a first slot region and has a first quarter-ellipse structure.

11. In the antenna structure of Embodiments 9-10, the first side and the fourth side form a first right angle, the first side and the second side form a second right angle, and the second side and the third side form a third right angle.

12. In the antenna structure of Embodiments 9-11, the first quarter-ellipse structure is defined by a first extended side extending from the third side, a second extended side extending from the fourth side, and the first curved side. The first extended side has a first extended length and the second extended side has a second extended length.

13. In the antenna structure of Embodiments 9-12, the first slot region has a first aspect ratio being the ratio of the second extended length and the first extended length, the first extended side and the second extended side form a first extended right angle, and the first curved side follows an elliptical trajectory of the first quarter-ellipse structure.

14. In the antenna structure of Embodiments 9-13, the second radiation portion includes the second printed portion and the second unprinted portion. The second printed portion includes a second boot-shaped structure and a second rectangular structure. The second boot-shaped structure has a second periphery, wherein the second periphery includes a fifth side, a sixth side, a seventh side, an eighth side and a second curved side. The sixth side has an upper portion and a lower portion. The seventh side is opposite to the fifth side. The eighth side is opposite to the sixth side. The second rectangular structure is connected to the lower portion of the sixth side and coplanar with the second boot-shaped structure. The second unprinted portion is a second slot region and has a second quarter-ellipse structure.

15. In the antenna structure of Embodiments 9-14, the fifth side and the eighth side form a fourth right angle, the fifth side and the sixth side form a fifth right angle, and the sixth side and the seventh side form a sixth right angle, the second quarter-ellipse structure is defined by a third extended side extending from the seventh side, a fourth extended side extending from the eighth side, and the second curved side, the third extended side has a third extended length and the fourth extended side has a fourth extended length.

16. In the antenna structure of Embodiments 9-15, the second slot region has a second aspect ratio being the ratio of the fourth extended length and the third extended length, the third extended side and the fourth extended side form a second extended right angle, the second curved side follows an elliptical trajectory of the second quarter-ellipse structure, and the second boot-shaped structure is symmetrical to the first boot-shaped structure along the axis.

17. In the antenna structure of Embodiments 9-16, the first aspect ratio and the second aspect ratio determine a size of the second area, the size of the second area determines a size of the first area, the first area determines a central operating frequency of the antenna structure, the second area determines an operating bandwidth and an impedance match of the antenna structure, the first aspect ratio ranges from 0.56 to 0.62, and the second aspect ratio ranges from 0.56 to 0.62.

18. The antenna structure of Embodiments 9-17 further includes a gap structure disposed between the first and the second radiating portions. The gap structure includes an inverted L-shaped structure and a reverse L-shaped structure. The inverted L-shaped structure consists of a first rectangular portion and a second rectangular portion, wherein the first rectangular portion has a first long side, a second long side opposite to the first long side, a first upper portion and a first lower portion, the second rectangular portion extends from the second long side and the first lower portion and forms a right angle with the first rectangular portion. The reverse L-shaped structure consists of a third rectangular portion and a fourth rectangular portion, wherein the fourth rectangular portion has a third long side, a fourth long side opposite to the third long side, a second upper portion and a second lower portion, and the third rectangular portion extends from the third long side and the second upper portion and forms a right angle with the fourth rectangular portion.

19. In the antenna structure of Embodiments 9-18, the first, second, third and fourth rectangular portions are coplanar, the first and second rectangular portions have sizes equivalent to those of the fourth and the third rectangular portions, respectively, the second and the third rectangular portions have sizes less than those of the first and the fourth rectangular portions respectively, and the inverted L-shaped structure is rotationally symmetric to the reverse L-shaped structure about a reference position.

20. In the antenna structure of Embodiments 9-19, the first rectangular structure is disposed between the first boot-shaped structure and the inverted L-shaped structure, and comprises a feed terminal for inputting a signal, the second rectangular structure is disposed between the second boot-shaped structure and the reverse L-shaped structure, and comprises a ground terminal free from a connection to a substrate, the feed terminal and the ground terminal are configured to connect to a coaxial cable including a feed line, a ground line, and an isolation layer disposed between the feed line and the ground line to isolate the feed line from the ground line, and the first rectangular structure is rotationally symmetric to the second rectangular structure about the reference position.

Based on the above, the present invention effectively solves the problems and drawbacks in the prior art, and thus it meets the demands of the industry and is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An antenna structure, comprising:
- a symmetrizing portion having an axis;
- two radiation portions symmetrically connected to the symmetrizing portion along the axis, wherein each of the two radiation portions is formed in a boot shape within a quadrilateral region having a first edge with a first length, a second edge with a second length, a third edge with a third length and a fourth edge with a fourth length, wherein each radiation portion comprises:
  - a first side having a length being equivalent to the first length;
  - a second side having a length being equivalent to the second length;
  - a third side having a length being at least one-sixth of the third length;
  - a fourth side having a length being at least one-fifth of the fourth length; and
  - a fifth side connecting the third side and the fourth side and forming an arc, wherein the arc follows a quarter trajectory of an ellipse; and
  - a first extended portion having a first extended length, being adjacent to the first radiation portion, located within the quadrilateral region, and extending from an end of the fifth side along the fourth side.

2. The antenna structure as claimed in claim 1, further comprising two non radiation portions, wherein each of the non-radiation portions is formed within the quadrilateral region and connected to the respective radiation portion, and has a quarter-elliptical area defined by a first extended side extending from the third side, a second extended side extending from the fourth side, and the fifth side.

3. The antenna as claimed in claim 1, wherein the first side and the fourth side form a first right angle, the first side and the second side form a second right angle, and the second side and the third side form a third right angle.

4. An antenna structure, comprising:
- a symmetrizing portion having an axis;
- a first radiation portion and a second radiation portion formed symmetrically adjacent to the symmetrizing portion along the axis, wherein each radiation portion is formed within a quadrilateral region having a first edge, a second edge, a third edge and a fourth edge, and each radiation portion comprises:
  - a first side having a first length corresponding to the first edge;
  - a second side having a second length corresponding to the second edge;
  - a third side having a third length corresponding to the third edge;
  - a fourth side having a fourth length corresponding to the fourth edge; and
  - a fifth side being an arc located within the quadrilateral region and connecting the third side and the fourth side with a specific curvature; and
- a first extended portion having a first extended length, being adjacent to the first radiation portion, located within the quadrilateral region, and extending from an end of the fifth side along the fourth side.

5. The antenna structure as claimed in claim 4, the first extended portion and the first radiation portion form a first angle of less than 90 degrees.

6. The antenna structure as claimed in claim 5, wherein:
- the first length and the first extended length determine a central operating frequency of the antenna structure;
- the first length and the second length are at least twice the third length and the fourth length, respectively; and
- the fifth side follows a quarter trajectory of an ellipse.

7. The antenna structure as claimed in claim 5, further comprising a second extended portion having a second extended length, being adjacent to the second radiation portion and located within the quadrilateral region, wherein the second extended portion extends from the end of the fifth side and along the fourth side, and the second extended portion and the second radiation portion form a second angle of less than 90 degrees.

8. The antenna structure as claimed in claim 7, wherein the first extended portion is symmetrical to the second extended portion about the axis.

9. An antenna structure, comprising:
- a symmetrizing portion having an axis;
- a first radiation portion and a second radiation portion formed symmetrically along the axis, wherein each of the first and second radiation portions comprises:
  - a quadrilateral region;
  - a printed portion having a first area formed within the quadrilateral region; and
  - an unprinted portion having a second area formed within the quadrilateral region, wherein the quadrilateral region is partitioned into the first area and the second area by an arc with a specific curvature, wherein the first radiation portion comprises a first printed portion including a first boot-shaped structure having a first periphery having:
    - a first side;
    - a second side having an upper portion and a lower portion;

a third side opposite to the first side;
a fourth side opposite to the second side; and
a first curved side; and a first extended portion having a first extended length, being adjacent to the first radiation portion and located within the quadrilateral region, and extending from an end of the first curved side along the fourth side.

10. The antenna structure as claimed in claim 9, wherein the first radiation portion further comprises a first rectangular structure connected to the upper portion and being coplanar with the first boot-shaped structure.

11. The antenna structure as claimed in claim 10, wherein the first side and the fourth side form a first right angle, the first side and the second side form a second right angle, and the second side and the third side form a third right angle.

12. The antenna structure as claimed in claim 11, wherein the first quarter-ellipse structure is defined by a first extended side extending from the third side, a second extended side extending from the fourth side, and the first curved side, and the first extended side has a first extended length and the second extended side has a second extended length.

13. The antenna structure as claimed in claim 12, wherein:

the first slot region has a first aspect ratio being the ratio of the second extended length and the first extended length;

the first extended side and the second extended side form a first extended right angle; and the first curved side follows an elliptical trajectory of the first quarter-ellipse structure.

14. The antenna structure as claimed in claim 13, wherein the second radiation portion comprises:

the second printed portion, comprising:

a second boot-shaped structure having a second periphery, wherein the second periphery comprises:

a fifth side;

a sixth side having an upper portion and a lower portion;

a seventh side opposite to the fifth side;

an eighth side opposite to the sixth side; and a second curved side; and a second rectangular structure connected to the lower portion of the sixth side and being coplanar with the second boot-shaped structure; and the second unprinted portion being a second slot region and having a second quarter-ellipse structure.

15. The antenna structure as claimed in claim 14, wherein the fifth side and the eighth side form a fourth right angle, the fifth side and the sixth side form a fifth right angle, and the sixth side and the seventh side form a sixth right angle, the second quarter-ellipse structure is defined by a third extended side extending from the seventh side, a fourth extended side extending from the eighth side, and the second curved side, the third extended side has a third extended length and the fourth extended side has a fourth extended length.

16. The antenna structure as claimed in claim 15, wherein:

the second slot region has a second aspect ratio being the ratio of the fourth extended length and the third extended length;

the third extended side and the fourth extended side form a second extended right angle;

the second curved side follows an elliptical trajectory of the second quarter-ellipse structure; and the second boot-shaped structure is symmetrical to the first boot-shaped structure along the axis.

17. The antenna structure as claimed in claim 16, wherein:

the first aspect ratio and the second aspect ratio determine a size of the second area;

the size of the second area determines a size of the first area;

the first area determines a central operating frequency of the antenna structure;

the second area determines an operating bandwidth and an impedance match of the antenna structure;

the first aspect ratio ranges from 0.56 to 0.62; and the second aspect ratio ranges from 0.56 to 0.62.

18. The antenna structure as claimed in claim 17, further comprising:

a gap structure disposed between the first and the second radiating portions, comprising:

an inverted L-shaped structure consisting of a first rectangular portion and a second rectangular portion, wherein the first rectangular portion has a first long side, a second long side opposite to the first long side, a first upper portion and a first lower portion, the second rectangular portion extends from the second long side and the first lower portion and forms a right angle with the first rectangular portion; and a reverse L-shaped structure consisting of a third rectangular portion and a fourth rectangular portion, wherein the fourth rectangular portion has a third long side, a fourth long side opposite to the third long side, a second upper portion and a second lower portion, and the third rectangular portion extends from the third long side and the second upper portion and forms a right angle with the fourth rectangular portion.

19. The antenna structure as claimed in claim 18, wherein:

the first, second, third and fourth rectangular portions are coplanar;

the first and second rectangular portions have sizes equivalent to those of the fourth and the third rectangular portions, respectively;

the second and the third rectangular portions have sizes less than those of the first and the fourth rectangular portions respectively; and the inverted L-shaped structure is rotationally symmetric to the reverse L-shaped structure about a reference position.

20. The antenna structure as claimed in claim 19, wherein:

the first rectangular structure is disposed between the first boot-shaped structure and the inverted L-shaped structure, and comprises a feed terminal for inputting a signal;

the second rectangular structure is disposed between the second boot-shaped structure and the reverse L-shaped structure, and comprises a ground terminal free from a connection to a substrate;

the feed terminal and the ground terminal are configured to connect to a coaxial cable including a feed line, a ground line, and an isolation layer disposed between the feed line and the ground line to isolate the feed line from the ground line; and the first rectangular structure is rotationally symmetric to the second rectangular structure about the reference position.

* * * * *